US008096217B2

(12) United States Patent
Chan

(10) Patent No.: US 8,096,217 B2
(45) Date of Patent: Jan. 17, 2012

(54) BASE FOR A PAPER PUNCH AND A PAPER PUNCH WITH SUCH A BASE

(75) Inventor: Kwok Ki Stephen Chan, Hong Kong (HK)

(73) Assignee: Lee Tack Plastic & Manufactory Ltd., New Territories (HK)

( * ) Notice: Subject to any disclaimer, the term of this patent is extended or adjusted under 35 U.S.C. 154(b) by 795 days.

(21) Appl. No.: 12/050,980

(22) Filed: Mar. 19, 2008

(65) Prior Publication Data

US 2009/0235801 A1 Sep. 24, 2009

(51) Int. Cl.
*B26D 7/00* (2006.01)
*B26F 1/14* (2006.01)

(52) U.S. Cl. ..... 83/167; 83/684

(58) Field of Classification Search ..... 83/698.91, 83/686, 167, 684, 467.1–468.94
See application file for complete search history.

(56) References Cited

U.S. PATENT DOCUMENTS 3,373,643 A * 3/1968 Spengler ..... 83/620
5,601,006 A * 2/1997 Quinn et al. ..... 83/588
6,000,139 A * 12/1999 Chan ..... 30/358
6,089,137 A * 7/2000 Lee ..... 83/621
6,711,977 B2 * 3/2004 Tsai ..... 83/167
6,739,244 B1 * 5/2004 Carbaugh ..... 101/3.1
2003/0070523 A1 * 4/2003 Lin ..... 83/669
2004/0129124 A1 * 7/2004 Chan ..... 83/588

* cited by examiner

*Primary Examiner* — Ghassem Alie
*Assistant Examiner* — Bharat C Patel
(74) *Attorney, Agent, or Firm* — William J. Sapone; Coleman Sudol Sapone P.C.

(57) ABSTRACT

A base for a paper punch includes an upper jaw, a lower jaw, and first and second bifurcated supports, fixedly secured with the upper and lower jaws. The base has first and second legs. A rear end of the upper jaw is fixedly joined with a rear end of the lower jaw. Each bifurcated support has upper and lower forks spaced apart from each other at a front end and fixedly joined with each other at a rear end. The forks are fixedly secured with respective lateral sides of the respective jaws. First ends of the legs are fixedly secured to either or both of the upper jaw and lower jaw, with a second end of the first leg fixedly secured to the rear end of the first bifurcated support. The second end of the second leg is fixedly secured to the rear end of the second bifurcated support.

11 Claims, 15 Drawing Sheets

Fig. 2A (PRIOR ART)
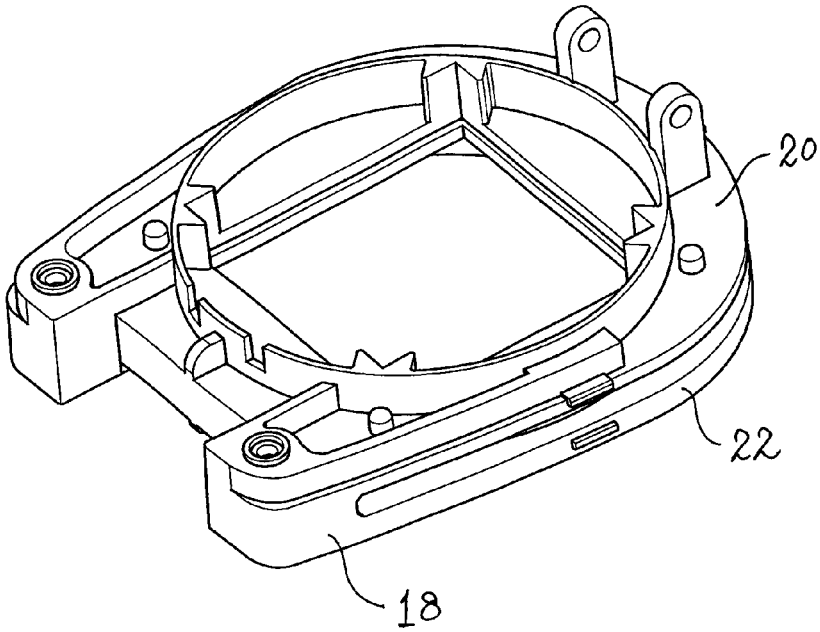
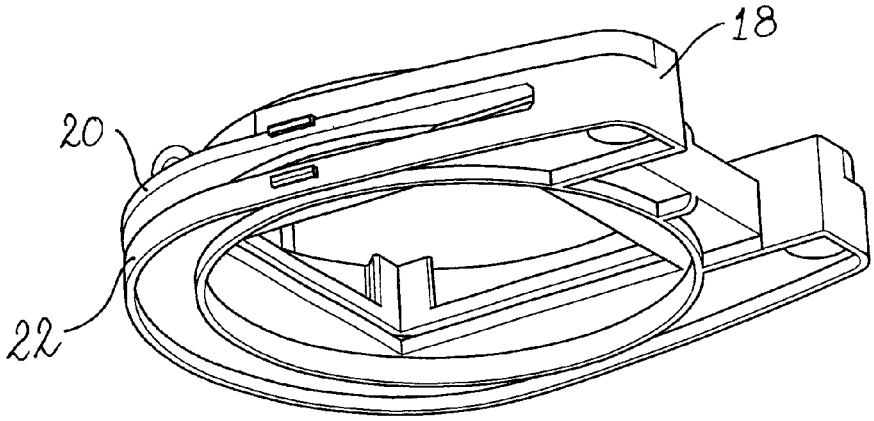
Fig. 2B (PRIOR ART)

BASE FOR A PAPER PUNCH AND A PAPER PUNCH WITH SUCH A BASE

This invention relates to a base for a paper punch and a paper punch with such a base and, in particular, such a paper punch suitable for paper-crafting purposes.

Background of the Invention

In the field of paper crafting, pieces of paper or cardboard of various shapes are punched out from sheets of paper or cardboard by paper punches. A conventional paper punch is shown in FIG. 1, generally designated as 10. The paper punch 10 has an operating handle 12 operatively associated with a main body 14. A generally horizontal slot 16 is provided in the main body 14 for insertion of one or more sheets of paper or cardboard. The operating handle 12 may be pivoted downwardly to move a punch die (not shown) relative to a die holder (also called a "base") (as shown in FIGS. 2 and 3) to punch or cut out pieces of shaped paper or cardboard from the piece(s) of paper or cardboard.

FIGS. 2 and 3 show, respectively, a top perspective view and a bottom perspective view of a conventional base 18 of the paper punch 10. The base 18 is made integrally of a metal or metal alloy, e.g. by die casting. The base 18 has an upper jaw 20 and a lower jaw 22, which are spaced apart from each other at their front end, to allow insertion of one or more sheets of paper or cardboard for punching. The upper jaw 20 and lower jaw 22 are joined with each other at their rear ends.

In such a conventional paper punch, the die and the base are made of metal or metal alloy (such as copper, aluminium, silver, zinc, tin or their alloys) by low pressure die cast, e.g. by injection moulding. Although it is known that the cost of the base, and thus the paper punch, can be reduced if at the base is made of less material, it has long been held by people in the field that the strength and rigidity of the base may be compromised if it is made of less material.

It is thus an object of the present invention to provide a base for a paper punch which is made of less material than conventional bases, and a paper punch with such a base, while minimizing the aforesaid shortcomings, or at least to provide a useful alternative to the trade and public.

Summary of the Invention

According to a first aspect of the present invention, there is provided a base for a paper punch, including an upper body member with a front end and a rear end; a lower body member with a front end and a rear end; at least a first and a second bifurcated members, both fixedly secured with said upper body member and lower body member; and at least a first and a second leg member, each with a first end and a second end; wherein said front end of said lower body member is spaced apart from said front end of said upper body member, and being adapted to allow insertion of at least a piece of paper for punching; wherein said rear end of said upper body member is fixedly joined with said rear end of said lower body member; wherein each of said first and second bifurcated members has a first fork member and a second fork member which are spaced apart from each other at a front end and fixedly joined with each other at a rear end; wherein said first fork members of said bifurcated members are fixedly secured with a respective lateral side of said upper body member; wherein said second fork members of said bifurcated members are fixedly secured with a respective lateral side of said lower body member; wherein said first ends of said leg members are fixedly secured to either or both of said first and second body members; and wherein said second end of said first leg member is fixedly secured to said rear end of said first bifurcated member, and said second end of said second leg member is fixedly secured to said rear end of said second bifurcated member.

According to a second aspect of the present invention, there is provided a paper punch including a paper punch die and a base for a paper punch, said base including an upper body member with a front end and a rear end; a lower body member with a front end and a rear end; at least a first and a second bifurcated members, both fixedly secured with said upper body member and lower body member; and at least a first and a second leg member, each with a first end and a second end; wherein said front end of said lower body member is spaced apart from said front end of said upper body member, and being adapted to allow insertion of at least a piece of paper for punching; wherein said rear end of said upper body member is fixedly joined with said rear end of said lower body member; wherein each of said first and second bifurcated members has a first fork member and a second fork member which are spaced apart from each other at a front end and fixedly joined with each other at a rear end; wherein said first fork members of said bifurcated members are fixedly secured with a respective lateral side of said upper body member; wherein said second fork members of said bifurcated members are fixedly secured with a respective lateral side of said lower body member; wherein said first ends of said leg members are fixedly secured to either or both of said first and second body members; and wherein said second end of said first leg member is fixedly secured to said rear end of said first bifurcated member, and said second end of said second leg member is fixedly secured to said rear end of said second bifurcated member.

Brief Description of the Drawings

Preferred embodiments of the present invention will now be described, by way of example only, with reference to the accompanying drawings, in which:

FIG. 2A is a top perspective view of a prior art base for the conventional paper punch shown in FIG. 1;

FIG. 2B is a bottom perspective view of the prior art base shown in FIG. 1;

Detailed Description of the Preferred Embodiments

Figure 1:
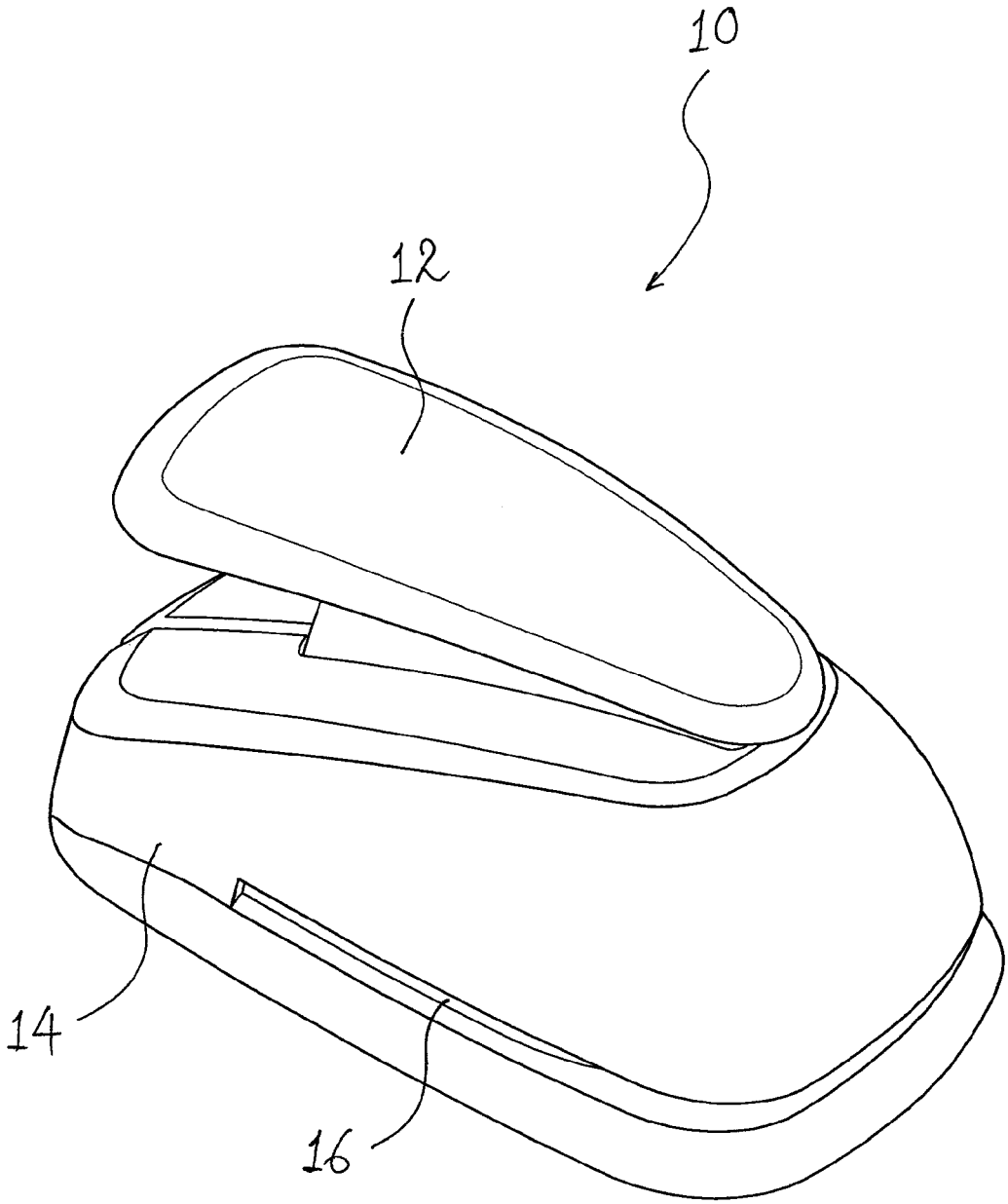
Fig. 1 (PRIOR ART)
FIG. 1 is a front perspective view of a prior art paper punch.
Figure 3A:
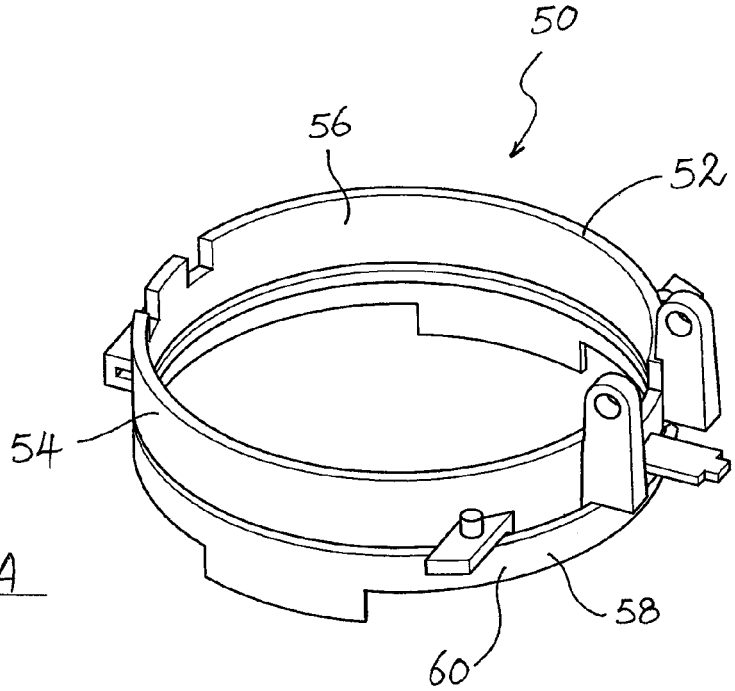
FIG. 3A is a front perspective view of an "ideal" base of a paper punch.
Figure 3B:
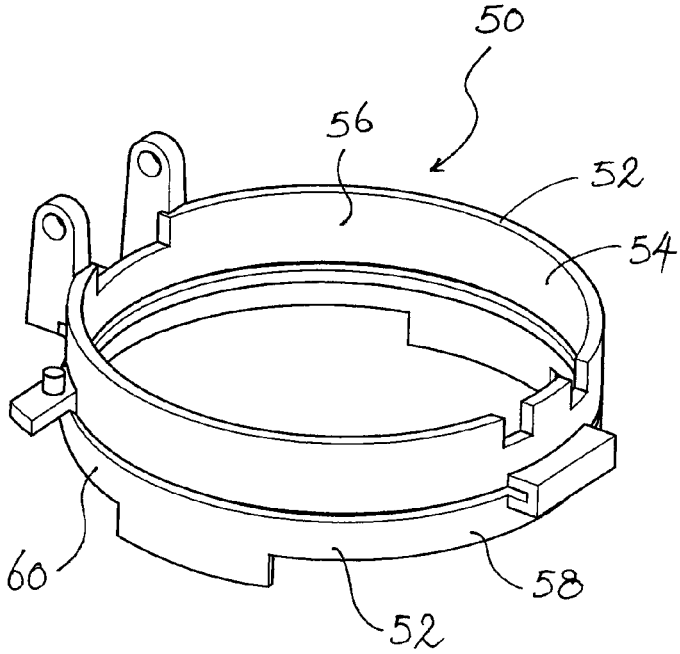
FIG. 3B is a rear perspective view of the base shown in FIG. 3A.
Figure 3C:
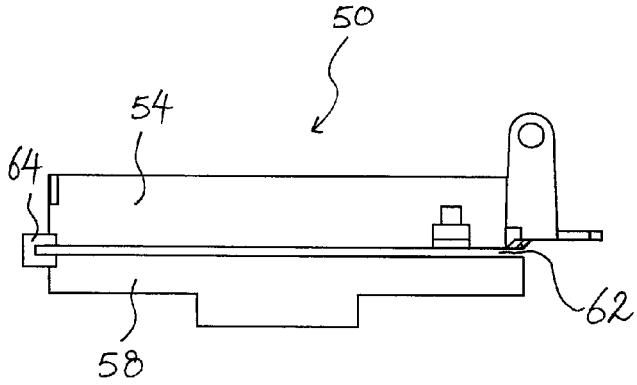
FIG. 3C is a side view of the base shown in FIG. 3A.
Figure 3D:
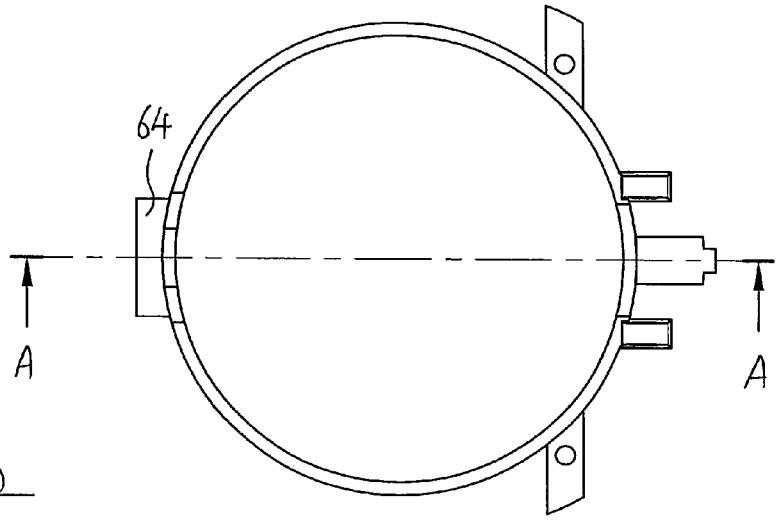
FIG. 3D is a top view of the base shown in FIG. 3A.
Figure 3E:
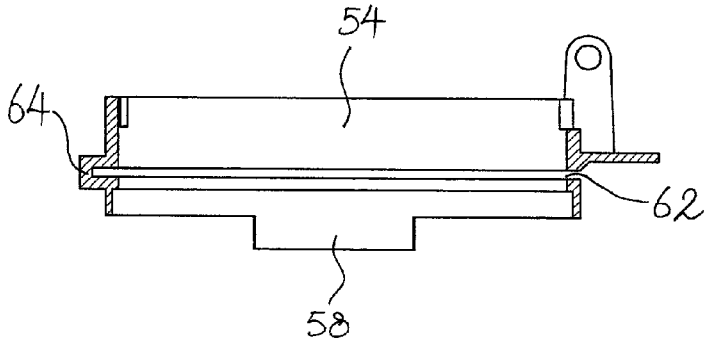
FIG. 3E is a sectional view of the base taken along the line A-A in FIG. 3D.

Although the present invention will hereinafter be referred to as, and described in the context, of a base for a paper punch and a paper punch with such a base, it is also envisaged that a paper punch according to the present invention is also suitable for punching cardboard and such like materials, and that the scope of protection should be construed accordingly.

FIGS. 3A to 3E show various views of an "ideal" base for a paper punch, generally designated as 50. The base 50 has a body 52 with an upper jaw 54 with a circular wall 56 and a lower jaw 58 with a circular wall 60. Each of the upper jaw 54 and the lower jaw 58 has a front end which are spaced apart from each other by a space 62 which allows insertion of at least a piece of paper to be punched or cut out by an operatively associated punch die (not shown) when passing through the upper jaw 54, then through the space 62, and then into the lower jaw 58. The rear end of the upper jaw 54 and the rear end of the lower jaw 58 are fixedly joined with each other by a connecting portion 64, which is fixedly secured with both the upper jaw 54 and the lower jaw 58. The whole base 50, including the connecting portion 64, may, for example, be formed integrally by injection moulding.

This "ideal" base 50 can, in theory, save material (as compared with the conventional base 18 shown in FIGS. 2A and 2B) without adversely affecting the performance of the paper punch, in particular in terms of the proper alignment of the base and the punch die before, during and after the punching action.

Figure 4:
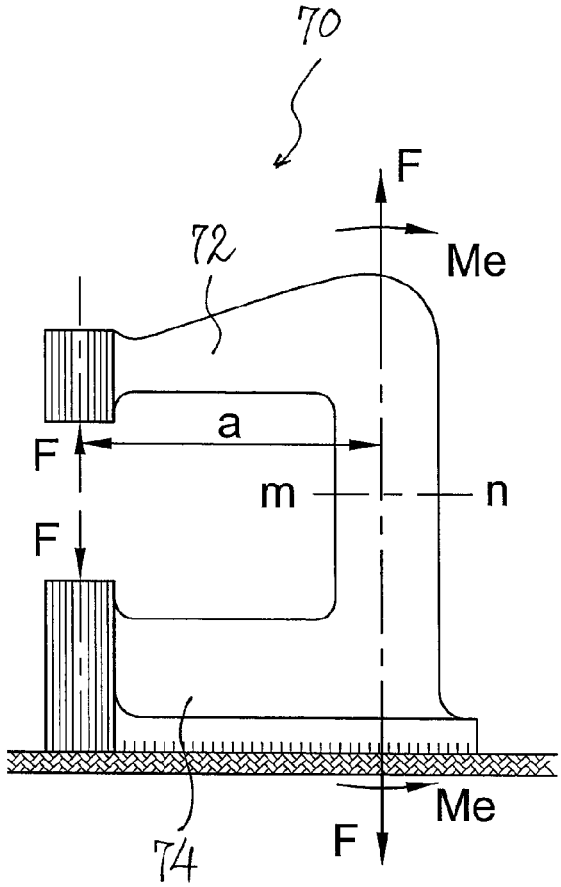
FIG. 4 shows schematically the forces acting on a base for a paper punch during operation.

However, it is known that, as shown in FIG. 4, upon operation of a paper punch with the "ideal" base 50, which can be simplified (for the purpose of analysis) as a generally C-shaped object 70, an upper arm 72 (which represents the upper jaw 54 of the base 50) of the object 70 experiences an upwardly acting force F, whereas a lower arm 74 (which represents the lower jaw 58 of the base 50) of the object 70 experiences a downwardly acting force F. The upwardly acting force F tends to turn the upper arm 72 in the clockwise direction with a moment (Me) with a magnitude of F×a, and the downwardly acting force F tends to turn the lower arm 74 in the anti-clockwise direction with a moment (Me) with a magnitude of F×a. These have the combined effect of pulling the arms 72, 74 apart from each other, thus deforming the object 70. This means that, after repeated operation of a paper punch incorporating the base 50, the base 50 will be deformed, thus adversely affecting the performance of the paper punch.

Figure 5:
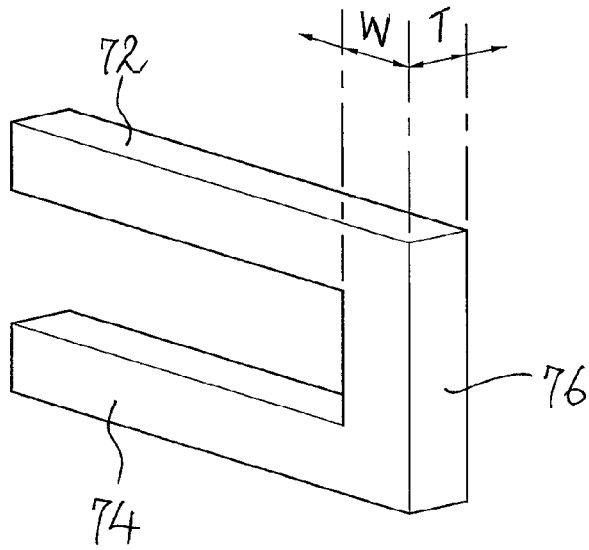
FIG. 5 shows the principle(s) in which the rigidity of the base may be enhanced.

One way of countering such a deforming effect is to increase the rigidity of the portion 76 joining the upper arm 72 and the lower arm 74, e.g. by increasing the width W and/or thickness T of the portion 76, as shown in FIG. 5.

Figure 6:
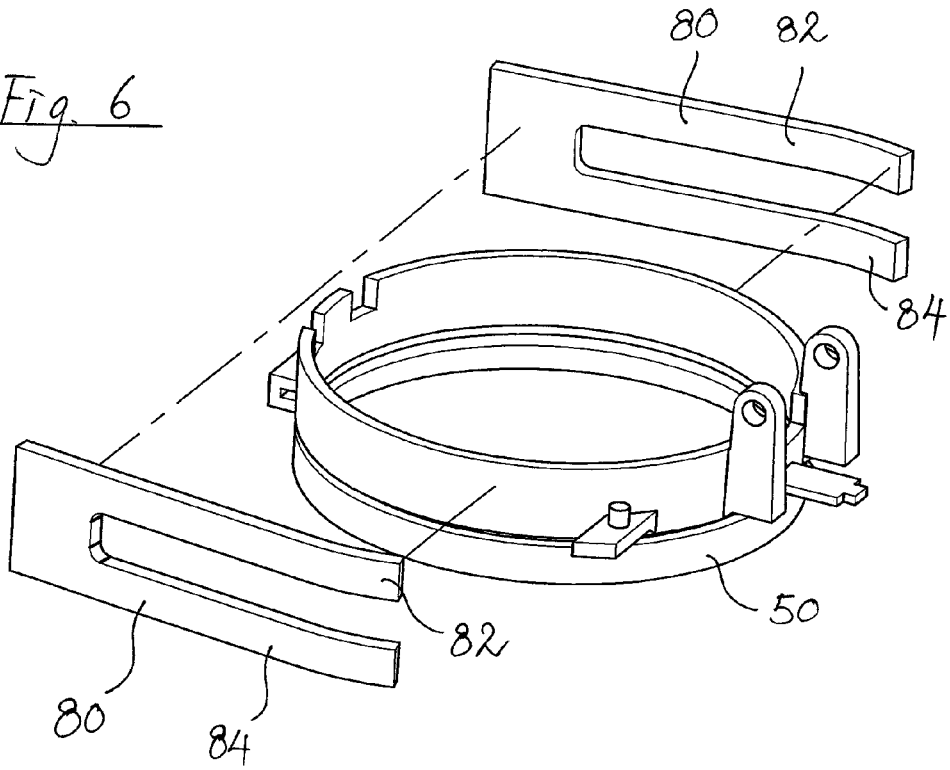
FIG. 6 shows two bifurcated members to be incorporated in the base shown in FIG. 3A.
Figure 7:
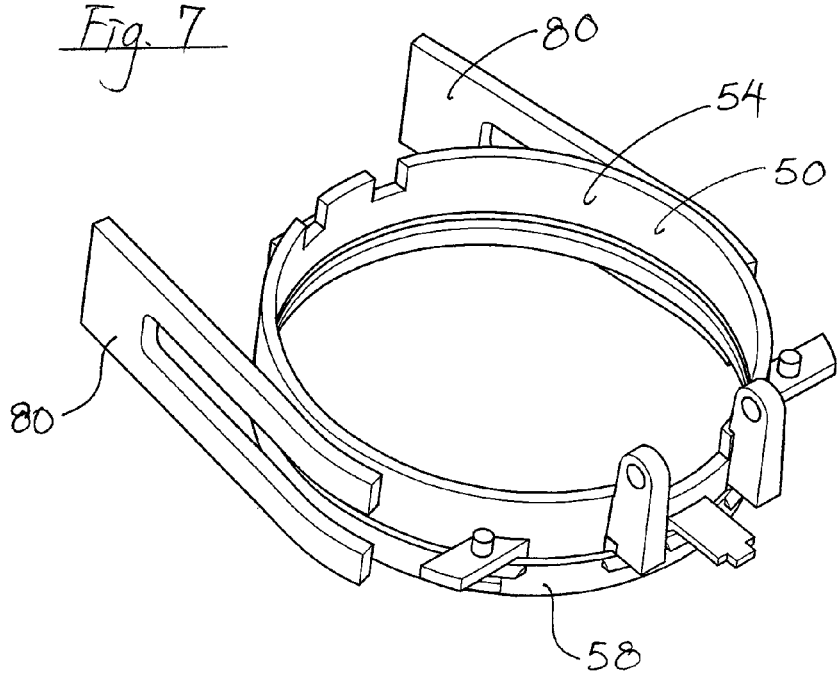
FIG. 7 shows the two bifurcated members incorporated in the base shown in FIG. 3A.

Adopting such a basic principle, and as shown in FIGS. 6 and 7, two generally C-shaped bifurcated supports 80 are fixedly secured to either side of the base 50. The bifurcated supports 80 and the base 50 may be integrally formed by injection moulding. In particular, each bifurcated member 80 has an upper fork 82 and a lower fork 82. The upper forks 82 are fixedly secured to either lateral side of the upper jaw 54 of the base 50, and the lower forks 84 are fixedly secured to either lateral side of the lower jaw 58 of the base 50.

Figure 8A:
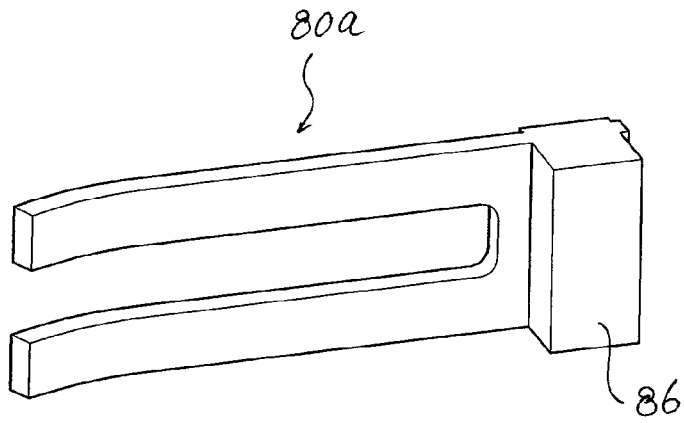
FIGS. 8A to 8C show bifurcated members of different shapes.
Figure 8B:
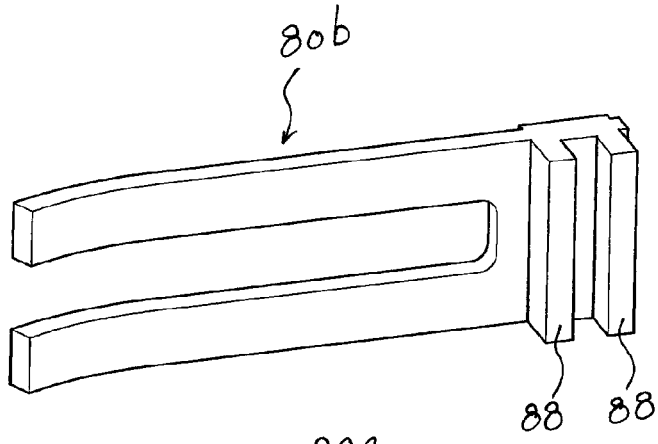
Figure 8C:
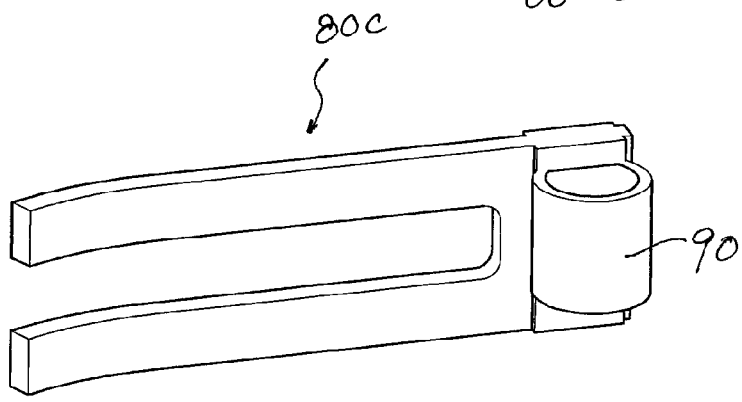

The bifurcated supports 80 shown in FIGS. 6 and 7 are generally planar, and are slightly curved towards the free ends of the forks 82, 84. To add further strength to the base with which the bifurcated supports 80 are incorporated, bifurcated supports 80*a*, 80*b*, 80*c* of different shapes may instead be provided, as shown in FIGS. 8A to 8C. In the supports 80*a*, 80*b*, 80*c*, the part 86 joining the two forks is thicker than the forks (as in the case of the support 80*a*), or contains ribs 88 (as in the case of the support 80*b*), or has a generally circular portion 90 (as in the case of the support 80*c*). All such arrangements have the effect of strengthening the supports 80*a*, 80*b*, 80*c*, by increasing the width and thickness of the portion joining the forks.

Figure 9:
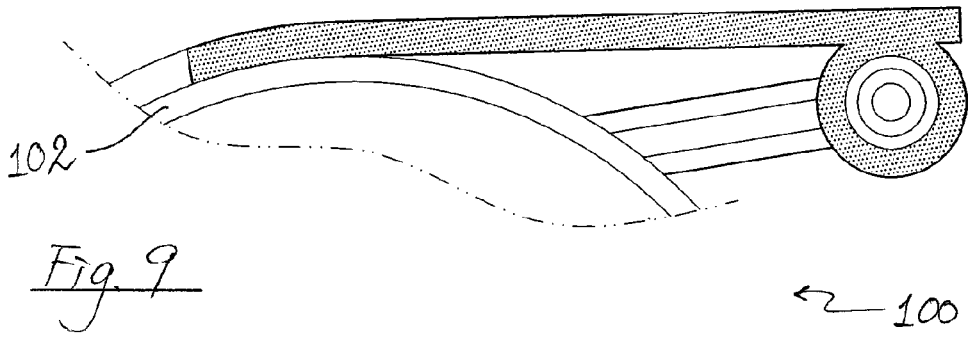
FIG. 9 shows a partial top view of a base for a paper punch, with a bifurcated member fixedly secured with a leg, according to a first embodiment of the present invention.
Figure 10A:
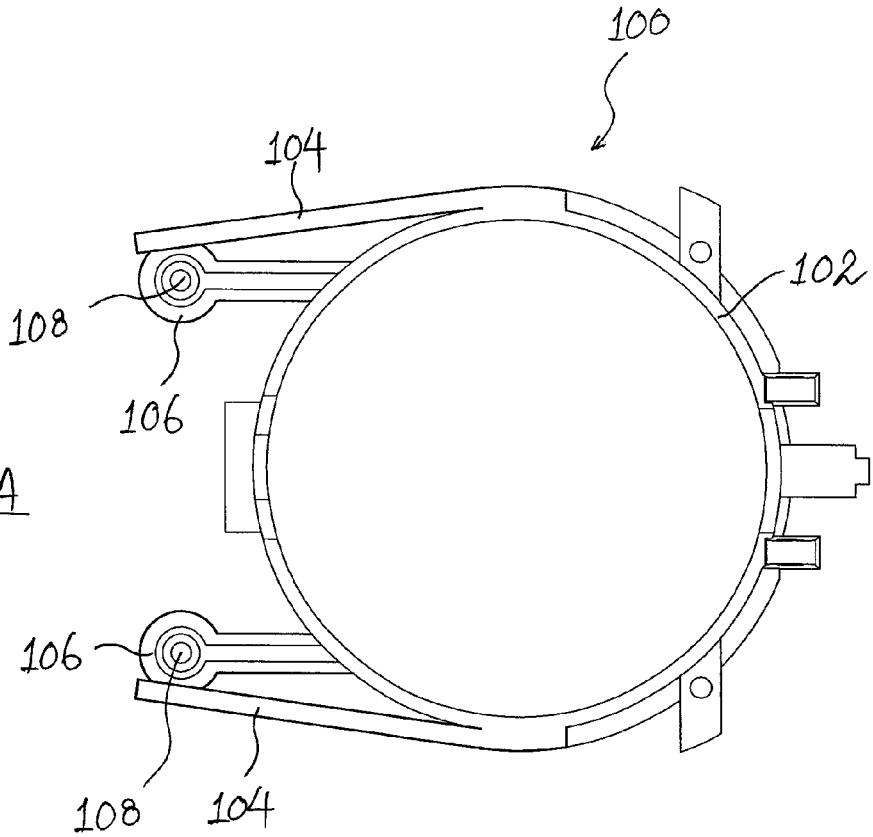
FIG. 10A is a top view of the base shown in FIG. 9.
Figure 10B:
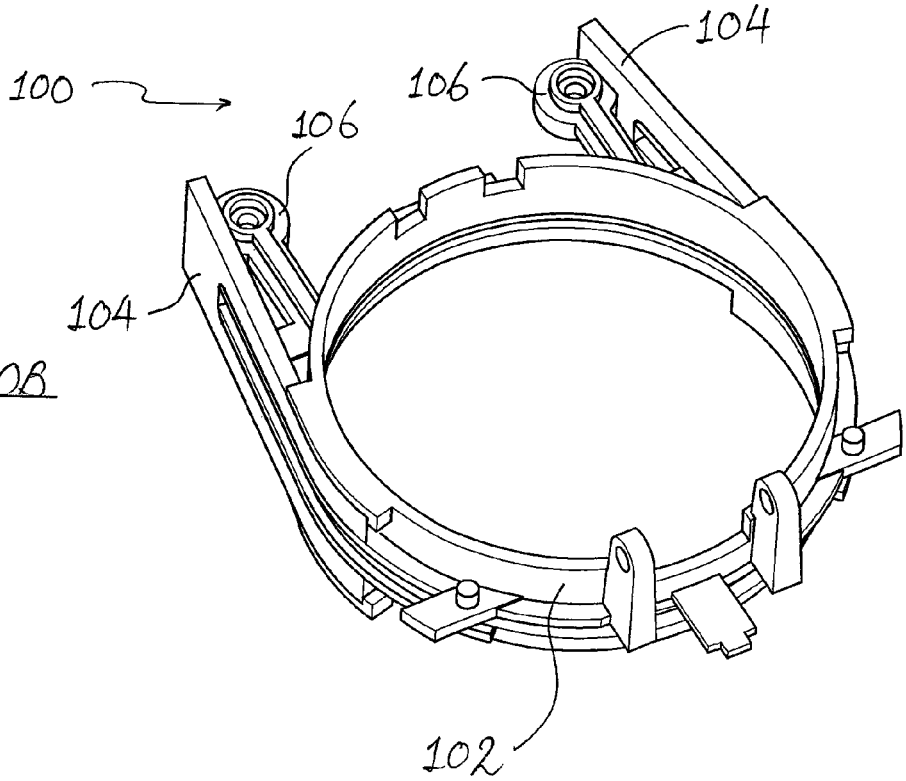
FIG. 10B is a perspective view of the base shown in FIG. 10A.

FIGS. 9 to 10B show a base according to a first embodiment of the present invention, generally designated as 100. The base has a body 102 which is similar to the base 50 discussed above, and the body 102 is fixedly secured with two bifurcated supports 104. The rear ends of the supports 104 are fixedly secured with rear ends of two legs 106. The rear ends of the legs 106 are each provided with a threaded through hole 108 allowing the base 100 to be secured by two screws (not shown) to a base plate (not shown) to form a paper punch. Alternatively, the through holes 108 may be not threaded, and the base 100 is fixedly secured to a base plate (not shown) by a pair of rivets (not shown).

Figure 11A:
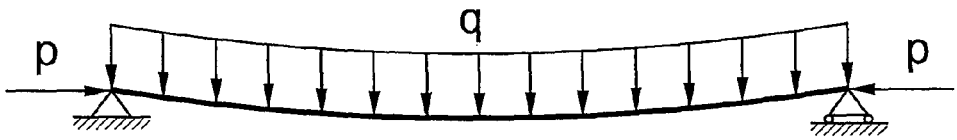
FIG. 11A is a schematic view showing the force acting on a length of material resting on two supports.
Figure 11B:
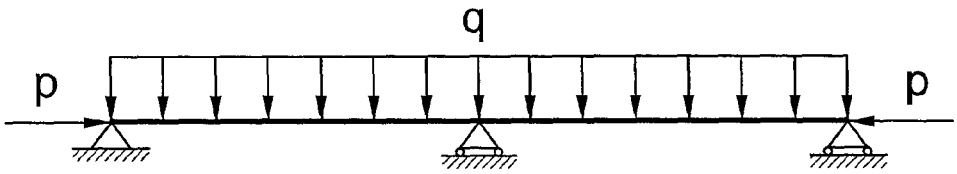
FIG. 11B is a schematic view showing the length of material shown in FIG. 11A resting on an additional support.

It can be seen that at least part of the supports 104 is spaced apart from the neighboring legs 106. It is however known, and as shown in FIG. 11A, that a length of material resting on two supports p may bend on its own weight, at q. In order to counter this effect, a further support may be positioned at q, as shown in FIG. 11B.

Figure 12A:
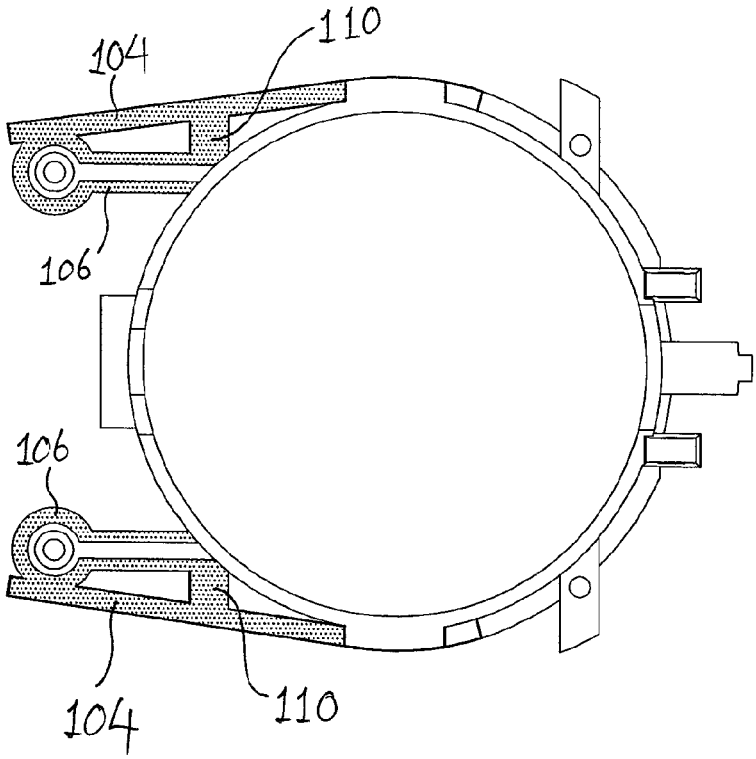
FIG. 12A shows a top view of a base for a paper punch according to a second embodiment of the present invention.
Figure 12B:
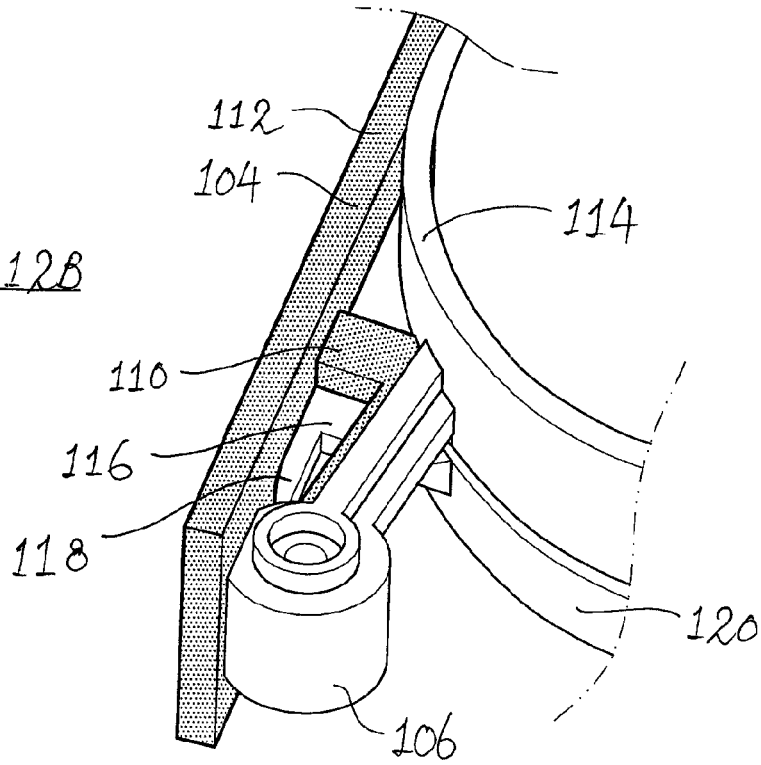
FIG. 12B is a partial perspective view of the base shown in FIG. 12A.

Adopting such a principle, and as shown in FIGS. 12A and 12B, ribs 110 are provided. Each of the ribs 110 is fixedly secured with and connects a respective support 104 and a neighboring leg 106 with which the support 104 connects at its rear end. The ribs 110 thus serve the purpose of strengthening the supports 104, the legs 106, and thus the body 102 of the base 100.

Figure 12C:
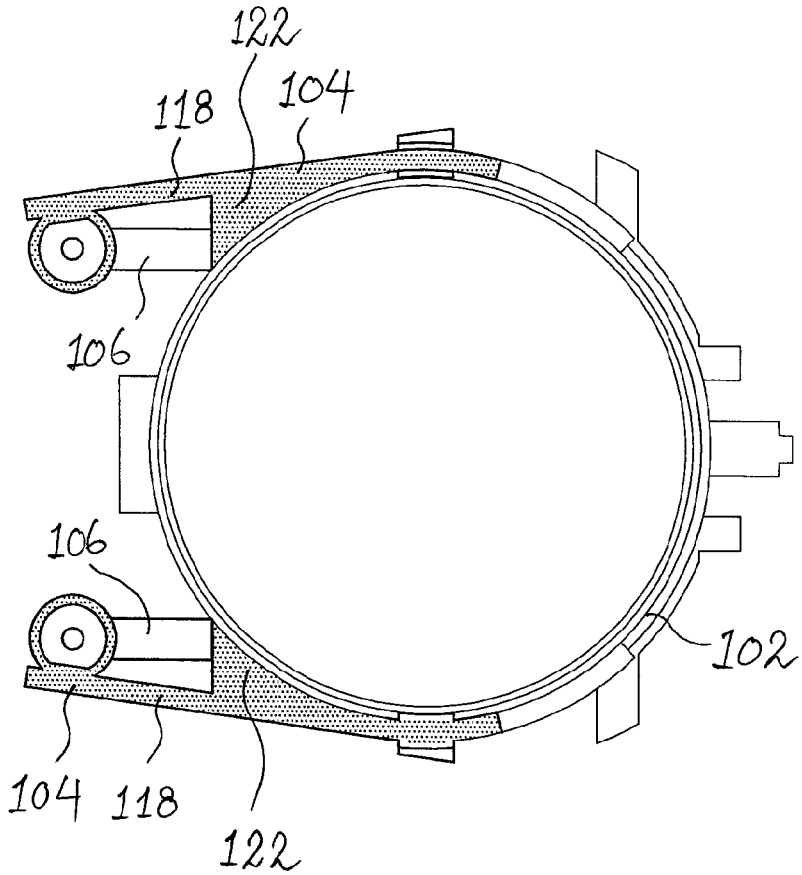
FIG. 12C is a bottom view of the base shown in FIG. 12A.
Figure 12D:
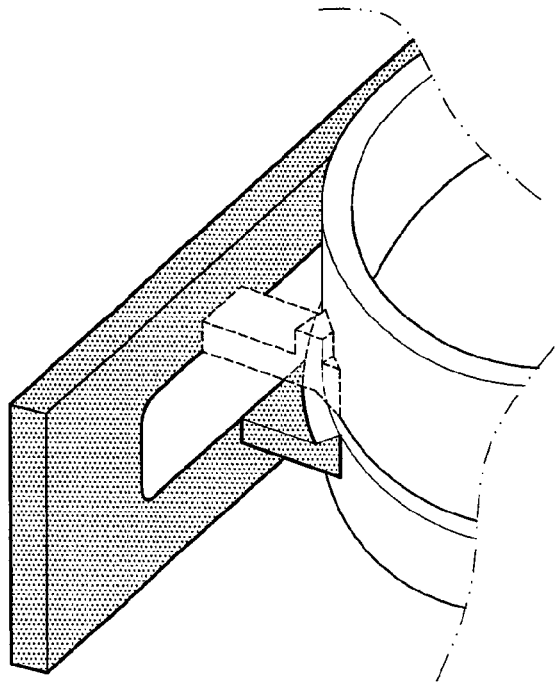
FIG. 12D is a partial perspective view of the base shown in FIG. 12C.
Figure 13A:
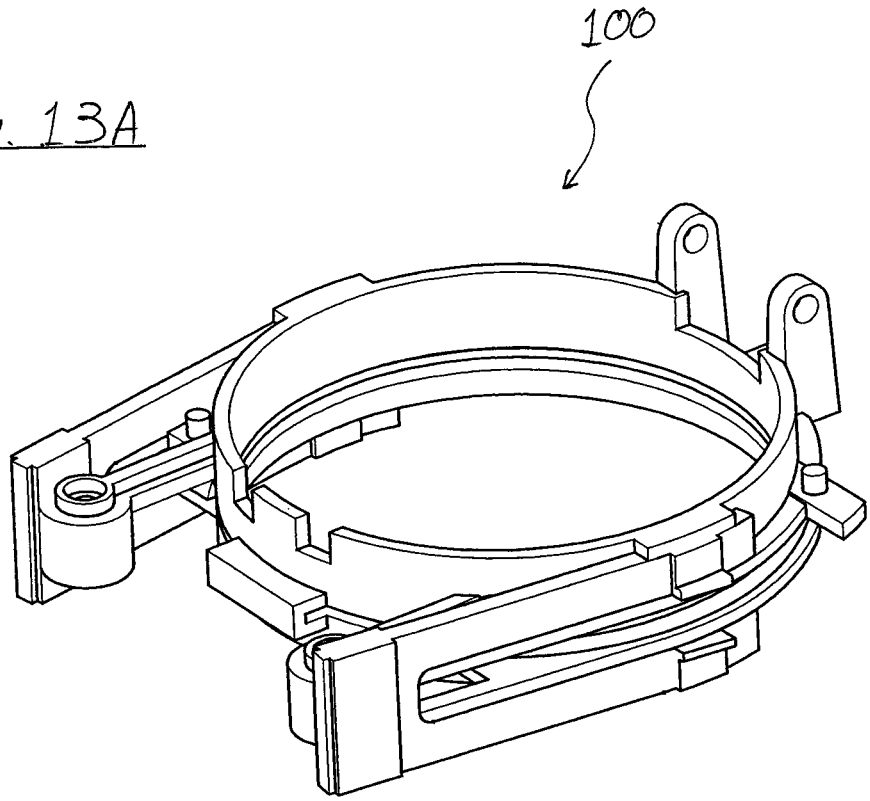
FIG. 13A is a perspective view of the base shown in FIG. 12A.
Figure 13B:
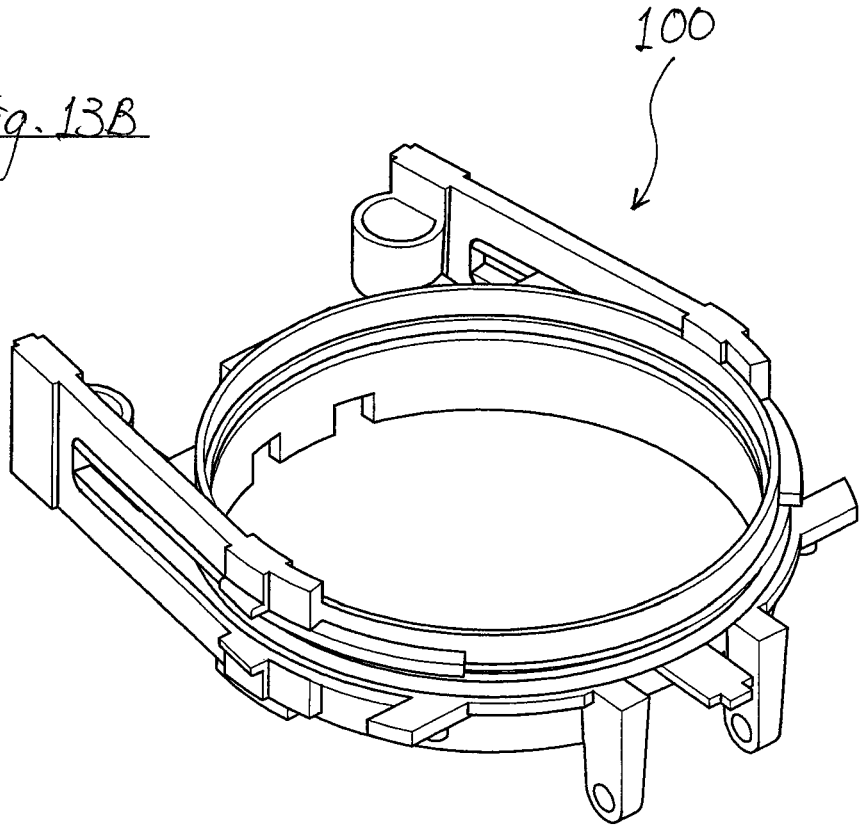
FIG. 13B is a further perspective view of the base shown in FIG. 13A.
Figure 13C:
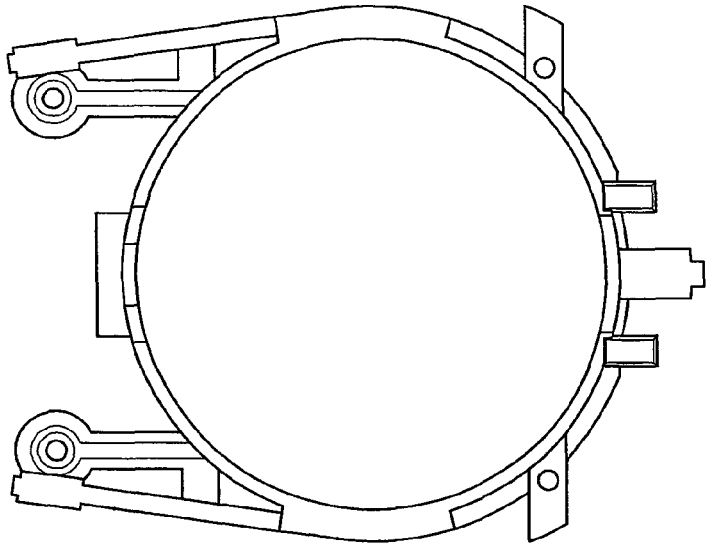
FIG. 13C is a top view of the base shown in FIG. 13A.
Figure 13D:
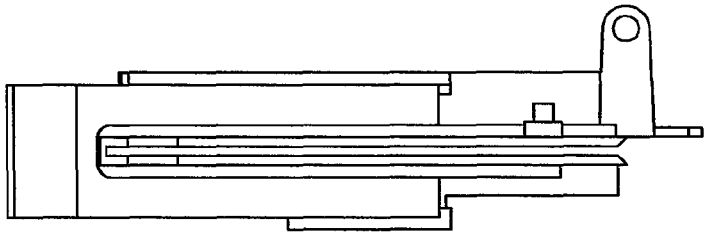
FIG. 13D is a side view of the base shown in FIG. 13C.
Figure 13E:
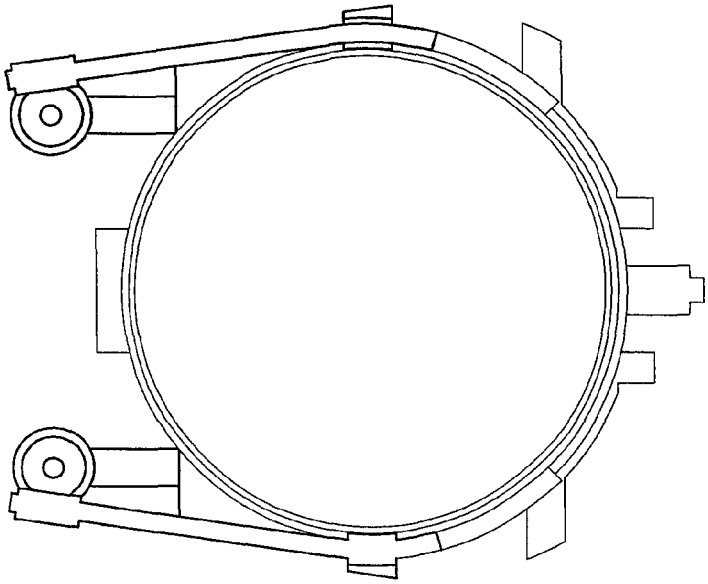
FIG. 13E is a bottom view of the base shown in FIG. 13C.

As shown in FIGS. 12A and 12B, the ribs 110 may be provided for connecting upper forks 112 of the supports 104 with an upper jaw 114 of the body 102, and similar ribs 116 (of which only one is shown in FIG. 12B) are provided for connecting lower forks 118 of the supports 104 with a lower jaw 120 of the body 102. FIG. 12D shows in dotted lines the position of the rib 116. Alternatively, and as shown in FIG. 12C, the lower forks 118 of the supports 104 are joined and integrally formed with the body 102 and the legs 106 by webs 122. FIGS. 13A to 13E show various views of the base 100. It should be understood that the entire base 100 is made integrally, e.g. by injection moulding, of a metal or metal alloy.

Figure 14A:
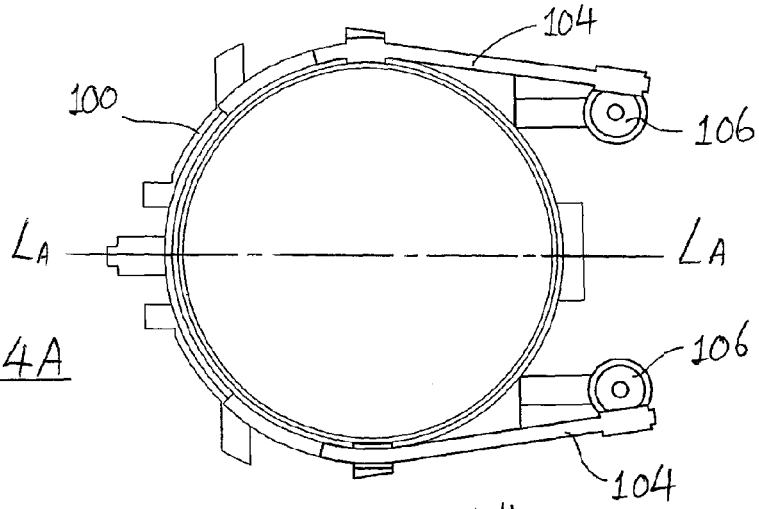
FIG. 14A is a bottom view of a base for a paper punch according to a third embodiment of the present invention.
Figure 14B:
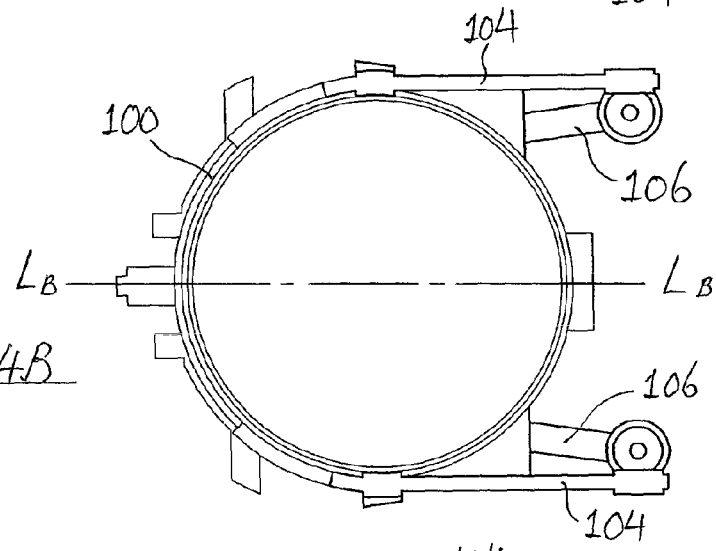
FIG. 14B is a bottom view of a base for a paper punch according to a fourth embodiment of the present invention.
Figure 14C:
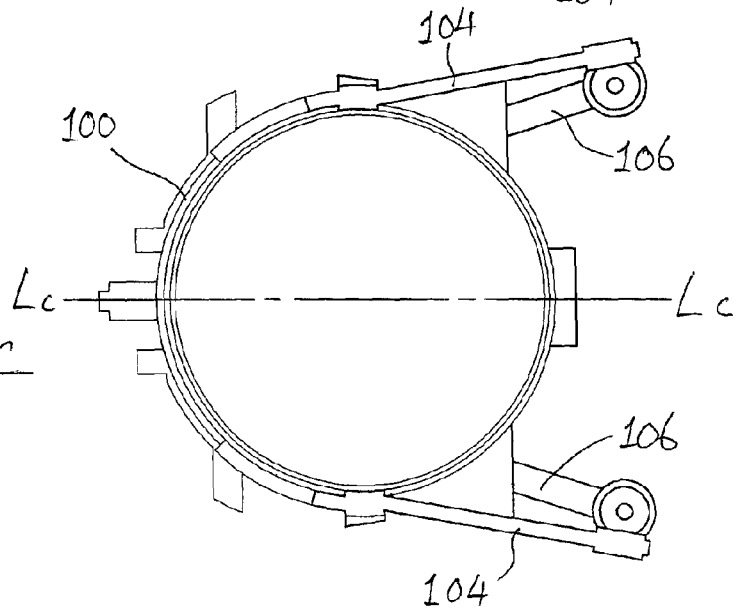
FIG. 14C is a bottom view of a base for a paper punch according to a fifth embodiment of the present invention.

The orientation of the supports 104 and the legs 106 may differ. For example, as shown in FIG. 14A, the rear ends of the supports 104 extend towards each other and are slanted relative to a central longitudinal axis LA-LA of the base 100, and the legs 106 extend parallel with each other and to the axis LA-LA. In the example shown in FIG. 14B, the supports 104 extend parallel to each other and to a central longitudinal axis LB-LB of the base 100, and the rear ends of the legs 106 extend away from each other. In the example shown in FIG. 14C, the supports 104 extend away from each other, and the legs 106 also extend away from each other.

Figure 15:
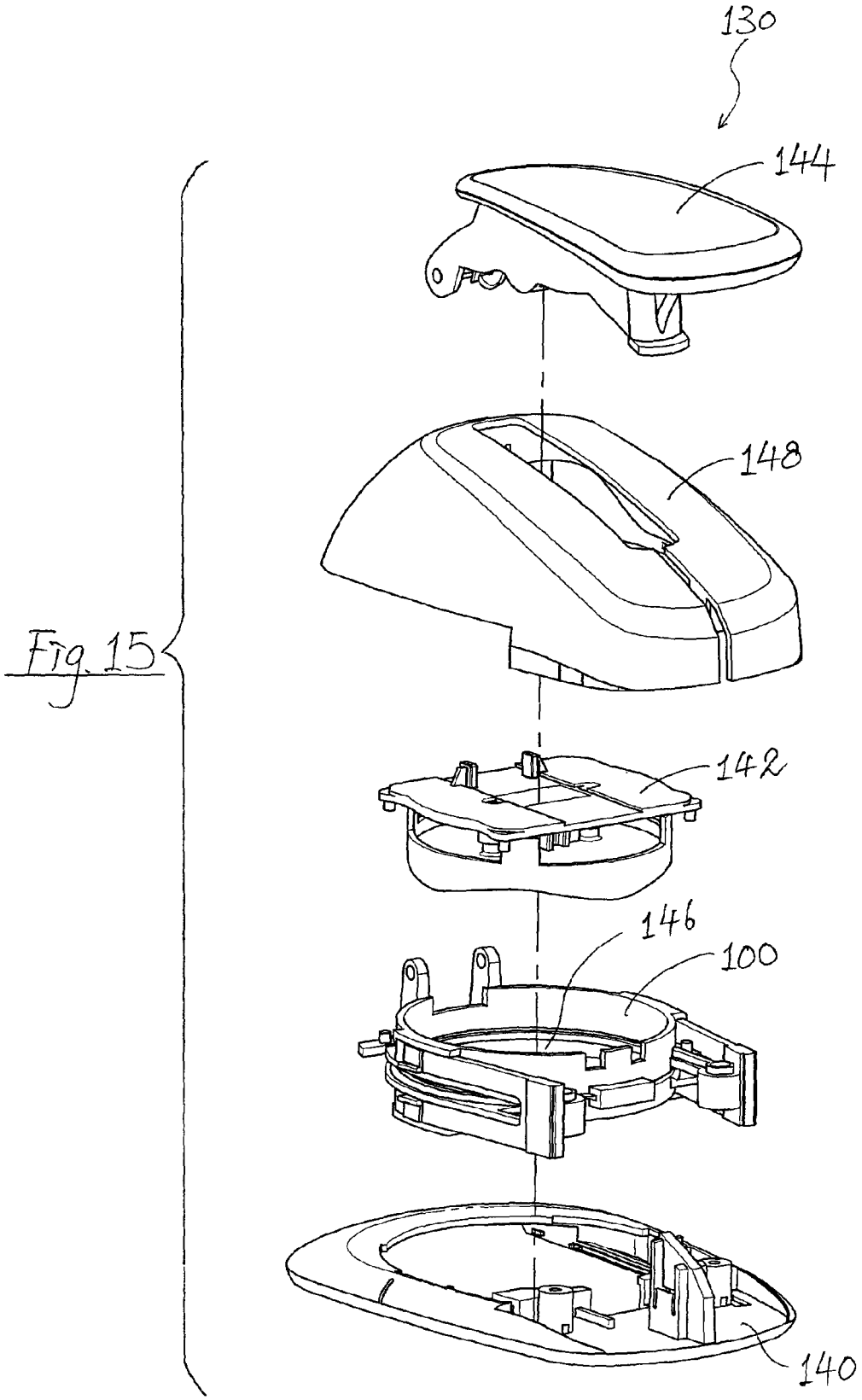
FIG. 15 is an exploded perspective view of a paper punch incorporating the base shown in FIG. 13A.

FIG. 15 shows a paper punch 130 incorporating the base 100 fixed with a base plate 140, e.g. by a number of screws or rivets. The paper punch 130 also includes a cover 148, and a punch die 142 operable by a lever 144 to move through a through hole 146 of the base 100 for punching at least a piece of paper.

It should be understood that the above only illustrates examples whereby the present invention may be carried out, and that various modifications and/or alterations may be made thereto without departing from the spirit of the invention.

It should also be understood that certain features of the invention, which are, for clarity, described in the context of separate embodiments, may be provided in combination in a single embodiment. Conversely, various features of the invention which are, for brevity, described in the context of a single embodiment, may also be provided separately or in any appropriate sub-combinations.

The invention claimed is:

1. A base for a paper punch, including:

an upper body member with a front end and a rear end;

a lower body member with a front end and a rear end;

at least a first and a second bifurcated members, both fixedly secured with said upper body member and said lower body member; and at least a first and a second leg member, each with a forward end and a rearward end;

wherein said front end of said lower body member is spaced apart from said front end of said upper body member, to form an opening adapted to allow insertion of at least a piece of paper for punching therein;

wherein said rear end of said upper body member is fixedly joined with said rear end of said lower body member;

wherein each of said first and second bifurcated members consist of an upper fork member and a lower fork member which are spaced apart from each other at a front end and fixedly joined with each other at a rear end;

wherein the front ends of said upper fork members of said bifurcated members are fixedly secured with a respective lateral side of said upper body member;

wherein the front ends of said lower fork members of said bifurcated members are fixedly secured with a respective lateral side of said lower body member, the space between the upper fork member and the lower fork members corresponding to the opening between the upper body member and the lower body member for allowing insertion of the piece of paper therein, rearward portions of the upper fork members and the lower fork members extending rearwardly away from the upper body member and lower body member, such that the rear ends of the fork members are spaced away therefrom;

wherein said forward ends of said leg members are fixedly secured to either or both of said upper body member and said lower body member;

wherein said rearward end of said first leg member is fixedly secured to said rear end of said first bifurcated member, and said rearward end of said second leg member is fixedly secured to said rear end of said second bifurcated member;

wherein said upper body member, said lower body member, said bifurcated members and said leg members are integrally formed with one another;

wherein at least part of said first leg member is separated from said first bifurcated member by a first space;

wherein a rib member is fixedly secured with said upper fork member of said first bifurcated member, said first leg member and said upper body member; and, wherein a rib member is fixedly secured with said lower fork member of said first bifurcated member, said first leg member and said lower body member.

2. A base according to claim 1 wherein a web member is fixedly secured with said upper fork member of said first bifurcated member, said first leg member and said upper body member.

3. A base according to claim 1 wherein a web member is fixedly secured with said lower fork member of said first bifurcated member, said first leg member and said lower body member.

4. A base according to claim 1 wherein at least part of said second leg member is separated from said second bifurcated member by a second space.

5. A base according to claim 1 wherein said rear ends of said bifurcated members extend generally towards each other.

6. A base according to claim 1 wherein said rear ends of said bifurcated members extend substantially parallel to each other.

7. A base according to claim 6 wherein said rear ends of said bifurcated members extend substantially parallel to a central longitudinal axis of said upper body member.

8. A base according to claim 1 wherein said leg members extend generally away from each other.

9. A base according to claim 1 wherein an aperture is provided at said second end of said first leg member, and being adapted to receive a securing member for securing said base to a base plate.

10. A base according to claim 9 wherein said securing member is a screw or rivet.

11. A paper punch including a paper punch die and a base for a paper punch according to claim 1.

* * * * *